US008453409B2

(12) United States Patent
Oliver et al.

(10) Patent No.: US 8,453,409 B2
(45) Date of Patent: Jun. 4, 2013

(54) SPACER

(76) Inventors: Gregory Stanley Oliver, Panania (AU); John Robert Roach, Ingleburn (AU); Mark Phillip Speechley, Casula (AU)

( * ) Notice: Subject to any disclaimer, the term of this patent is extended or adjusted under 35 U.S.C. 154(b) by 0 days.

(21) Appl. No.: 12/595,951

(22) PCT Filed: Apr. 18, 2008

(86) PCT No.: PCT/AU2008/000545

§ 371 (c)(1),
(2), (4) Date: Feb. 17, 2010

(87) PCT Pub. No.: WO2008/128284

PCT Pub. Date: Oct. 30, 2008

(65) Prior Publication Data

US 2010/0146891 A1 Jun. 17, 2010

(30) Foreign Application Priority Data

Apr. 18, 2007 (AU) ..... 2007902035
Aug. 14, 2007 (AU) ..... 2007904371
Dec. 24, 2007 (AU) ..... 2007907086

(51) Int. Cl.
*E04D 1/34* (2006.01)

(52) U.S. Cl.
USPC ..... 52/538; 52/551; 52/783.19; 52/798.1

(58) Field of Classification Search
USPC ..... 52/783.19, 798.1, 856, 783.11, 783.13, 52/783.17, 551, 302.1, 537, 538, 528, 748.1, 52/748.11
See application file for complete search history.

(56) References Cited

U.S. PATENT DOCUMENTS

| | | | | |
|---|---|---|---|---|
| 1,386,130 | A * | 8/1921 | Marks et al. | 52/394 |
| 4,194,521 | A * | 3/1980 | Banta | 137/67 |
| 4,348,846 | A * | 9/1982 | Bellem | 52/410 |
| 4,516,371 | A | 5/1985 | Simpson | |
| 5,584,153 | A * | 12/1996 | Nunley et al. | 52/410 |
| 5,600,971 | A * | 2/1997 | Suk | 52/713 |
| 6,401,412 | B1 * | 6/2002 | Cooper | 52/302.1 |
| 6,691,482 | B1 * | 2/2004 | Ault | 52/450 |
| 6,944,997 | B2 * | 9/2005 | Verkamp | 52/309.4 |
| 6,959,519 | B2 * | 11/2005 | Adriaansen | 52/537 |
| 7,454,876 | B2 * | 11/2008 | Kelly | 52/746.11 |
| 7,805,900 | B2 * | 10/2010 | Kelly | 52/309.2 |
| 7,877,955 | B2 * | 2/2011 | Kelly | 52/746.11 |
| 8,141,312 | B1 * | 3/2012 | Koble et al. | 52/551 |
| 2009/0266017 | A1 * | 10/2009 | Estes et al. | 52/302.1 |

FOREIGN PATENT DOCUMENTS

| | | | |
|---|---|---|---|
| FR | 2873139 | A | 1/2006 |
| GB | 2062721 | A | 5/1981 |
| GB | 2395205 | A | 5/2004 |
| WO | WO 03/078753 | A | 9/2003 |

* cited by examiner

*Primary Examiner* — William Gilbert
*Assistant Examiner* — Gisele Ford
(74) *Attorney, Agent, or Firm* — Knobbe Martens Olson & Bear LLP

(57) ABSTRACT

A spacer (100) for providing space between a first roof member (110) and a second roof member (120), where the spacer limits compression of an insulator (130), the insulator (130) being at least partially between the first roof member (110) and the second roof member (120).

23 Claims, 26 Drawing Sheets

SPACER

FIELD OF THE INVENTION

The present invention relates to a device, and in particular, to a device such as a spacer, or the like, for providing space between roof members.

DESCRIPTION OF THE BACKGROUND ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Presently, insulators, such as fibreglass insulators or the like, are often used in the roofs of buildings, in order to help maintain a particular temperature within the building.

Insulators are often inserted in between the roof sheet metal and the roof purlin or rafters. Current regulations require the achievement of certain R rating to the insulation installed under metal roof sheeting, which indicates the proportion of heat that can be maintained by the insulator.

However, the R rating of an insulator is often compromised by certain roof members compressing against each other, such as the roof safety mesh compressing the insulation against the metal roof sheet.

Accordingly, there is required a device/apparatus and/or method to substantially overcome, or at least ameliorate, one or more disadvantages of existing arrangements, or to provide an alternative to the existing arrangements.

SUMMARY OF THE PRESENT INVENTION

In a first broad form, there is provided a spacer for providing space between a first roof member and a second roof member, wherein the spacer limits compression of an insulator, the insulator being at least partially between the first roof member and the second roof member.

In a second broad form, there is provided a spacer for providing space between a first roof member and a second roof member, the space being able to at least partially receive an insulator, wherein the spacer limits compression of the insulator.

In a third broad form, there is provided a roof clip, the roof clip being provided between a first roof member and a second roof member, the roof clip including a spacer, the spacer being provided between the roof clip and the second roof member, thereby providing a space between the roof clip and the second roof member such that compression of an insulator between the first roof member and the second roof member is limited.

In a fourth broad form, there is provided a method of providing space between a first roof member and a second roof member, the method including the steps of placing a spacer between the first roof member and the second roof member, the spacer being configured to limit compression of an insulator, the insulator being at least partially between the first roof member and the second roof member.

In a fifth broad form, there is provided a method of constructing a roof, the method including providing a spacer between a first roof member and a second roof member, the spacer being configured to limit compression of an insulator, the insulator being at least partially between the first roof member and the second roof member.

In a sixth broad form, there is provided a roof support bracket, the roof support bracket including:

(a) an elongate body; and, (b) a spacer attached to and extending from the elongate body;

wherein the roof support bracket is provided between a first roof member and a second roof member, to provide a space between the first roof member and the second roof member such that compression of an insulator between the first roof member and the second roof member is limited.

In one example, the spacer is a roof bracket formed from supporting legs extending from a supporting body.

In a further example, the spacer forms a part of a roof clip.

In another aspect, the spacer is screwed to the second roof member.

In a further aspect, the spacer is of a height that substantially maintains the thickness of the insulator.

In a further example, the space provided by the spacer can range from 10 mm to 120 mm.

In another example, the first roof member is a roof sheet.

In yet, another aspect, the second roof member is any one or combination of roof purlin; roof safety mesh; and, roof rafters.

In another example, the spacer is a single piece light weight crenellated insulation support bracket.

In a further example, the spacer is equal in length to the width of a roof sheet.

In a further example, the spacer has any one or a combination of:

(a) a U-Shaped cross-section;

(b) a reverse U-shaped cross-section;

(c) a Z-shaped cross-section;

(d) C-shaped cross-section;

(e) a square cross-section; and, (f) a trapezoidal cross-section.

BRIEF DESCRIPTION OF THE DRAWINGS

An example of the present invention will now be described with reference to the accompanying drawings, in which:—

MODES FOR CARRYING OUT THE INVENTION

Figure 1:
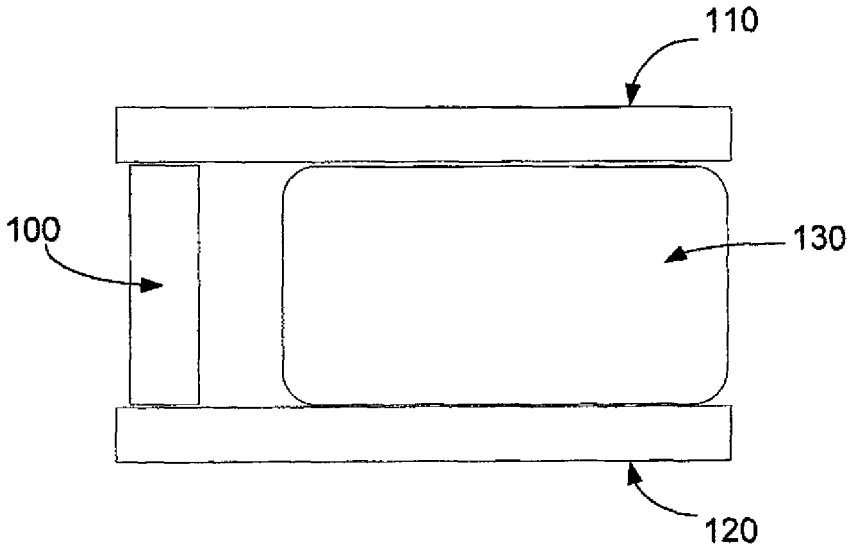
FIG. 1 is a schematic diagram of an example of a spacer for providing space between roof members.

FIG. 1 shows a device for providing space between roof members.

In particular, FIG. 1 shows a spacer 100 for providing space between a first roof member 110 and a second roof member 120. The spacer aims to limit compression of an insulator 130, which is at least partially between the first roof member 110 and the second roof member 120.

Figure 2A:
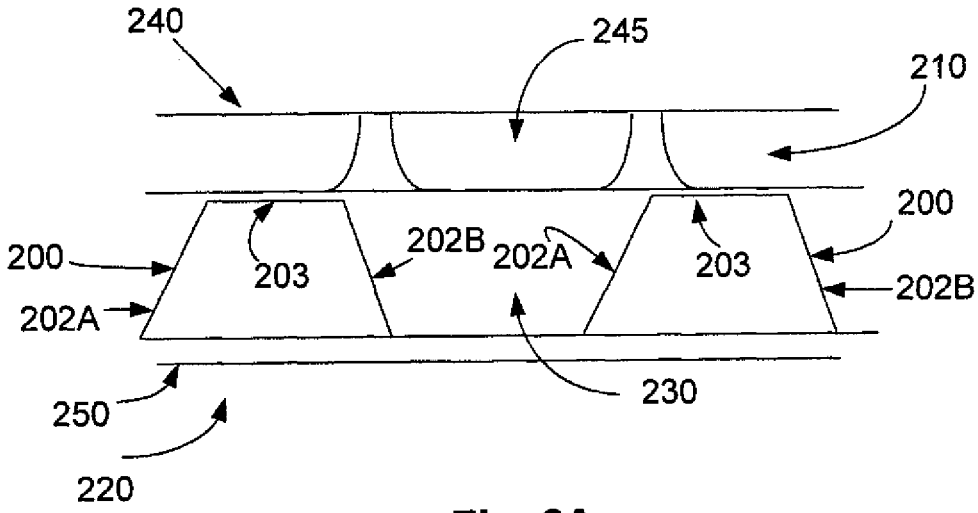
FIG. 2A is another schematic diagram of another example of a spacer for providing space between roof members.

FIG. 2A shows an example use of a spacer 200, where the spacer 200 is in the form of (or forms a part of) a roof bracket or the like. In this example, the spacer 200 includes supporting legs 202A, 202B extending from a supporting body 203.

In this example, the spacer 200 provides space for the insulator 230 between a first roof member 210 and a second roof member 220. In this particular example, it will be appreciated that the first roof member 210 can include any one or a combination of a roof clip 245, and/or a roof sheet 240, and/or a roof support channel (as described below). Further, the second roof member 220 can include any one or a combination of roof purlin, and/or roof rafters, and/or roof safety mesh 250.

Accordingly, in the example shown in FIG. 2, the spacer 200 is provided between a roof clip 245 and the second roof member 220. It will be appreciated by persons skilled in the art that the spacer 200, in one example, can be separate to the roof clip 245, attachable (and also detachable) to the roof clip 245, or can form a part of the roof clip 245. Thus, the spacer 200 can form a part of or be attached to any one or a combination of the first or second roof members 210, 220, respectively.

Additionally, it will be appreciated that the spacer 200 can be attached to the second roof member 220 in any manner, and in one example, the spacer 200 is screwed to the second roof member.

Figure 2B:
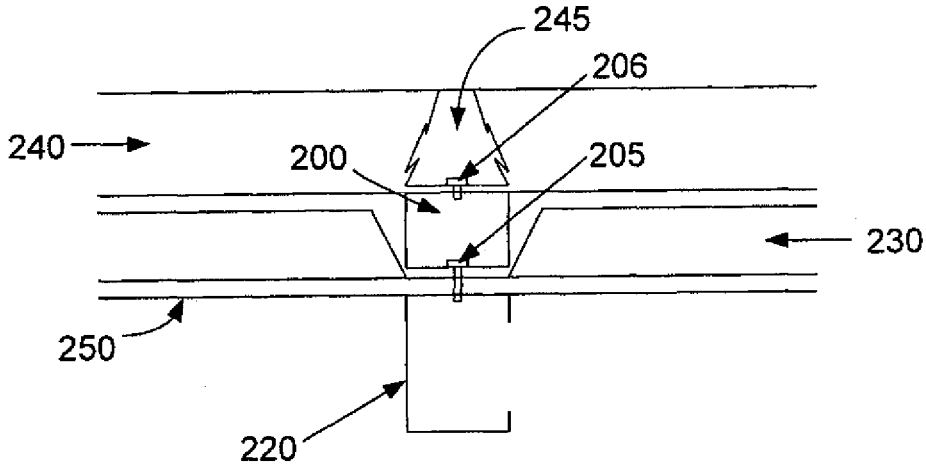
FIG. 2B is another schematic diagram of another example of a spacer for providing space between roof members.

Similarly, in the example shown in FIG. 2B, a spacer 200 (which, in this example is an air-gap bracket) is screw-fixed at 205 to the roof purlin 220. The roof clip 245 is attached to the bracket 200 via screw 206. Accordingly, the bracket 200 provides a gap (and in one example, an air gap), for the roof insulation 230, so that compression of the roof insulation 230 is substantially limited, between the roof safety mesh 245 and the roof sheet 240.

Furthermore, it will be appreciated that the spacer 200 can be of any height that is suitable for substantially maintaining the thickness of the insulator 230. In one example, the spacer 200 can be configured such that it is of variable height.

SPECIFIC EXAMPLES

Various forms of spacers 300A to 300D are shown in FIGS. 3 to 6.

Figure 3:
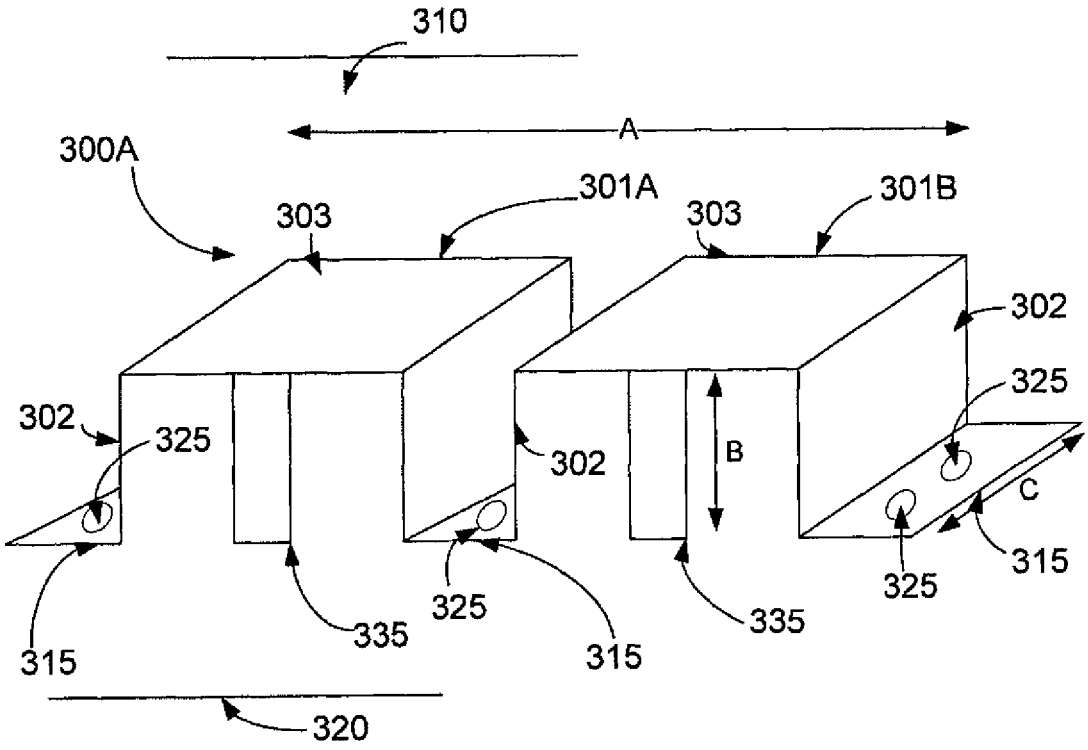
FIG. 3 a schematic diagram of an example spacer.
Figure 5:
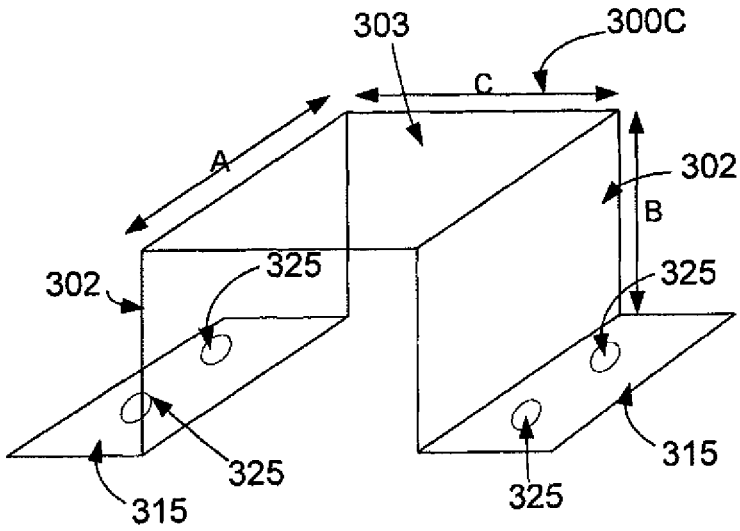
FIG. 5 is schematic diagram of another example spacer.

FIG. 3 shows an example of a spacer 300A, which can include two spacing elements 301A, 301B (each of which can be a spacer on its own, as shown in the spacer 300B of FIG. 5). The spacing elements 301A, 301B can be provided along a roof clip or the like such that sufficient space is provided for an insulator, and such that sufficient strength is provided to hold a roof clip 310 above the second roof member 320.

The spacers 301A, 301B can include supporting legs 302 extending from a supporting body 303. In this particular example, the supporting legs 302 have a flange or a batten 315, or the like, which is able to further support the spacer 301A, 301B on the second roof member 320.

Accordingly, in one example, the spacer 301A, 301B can be fixed to the second roof member 320 with the use of roof tek screws or the like, which can be screwed in via slots 325 provided in the flange 315. It will be appreciated that various forms of tek screws can be used (such as 12/16), and that other forms of connecting means can also be used to connect the spacers 301A, 301B to the second roof member 320.

FIG. 3 also shows the use of a mid support 335, which can be in the form of a "U"-shaped element that is attached to the supporting body 303. The mid-support 335 can offer more support and stability to the spacer 301A, 301B, along with further fixings points if required. It will be appreciated that the mid support 335 does not have to be located exactly in the middle of the supporting legs 302.

Figure 4:
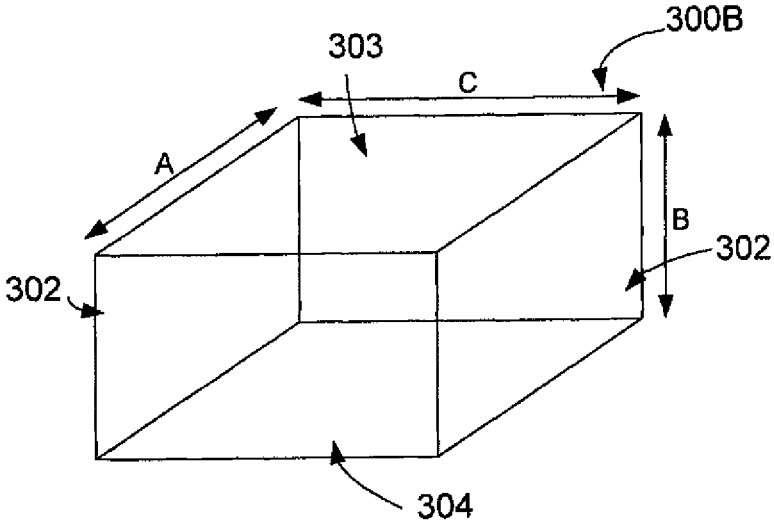
FIG. 4 is schematic diagram of another example spacer.
Figure 6:
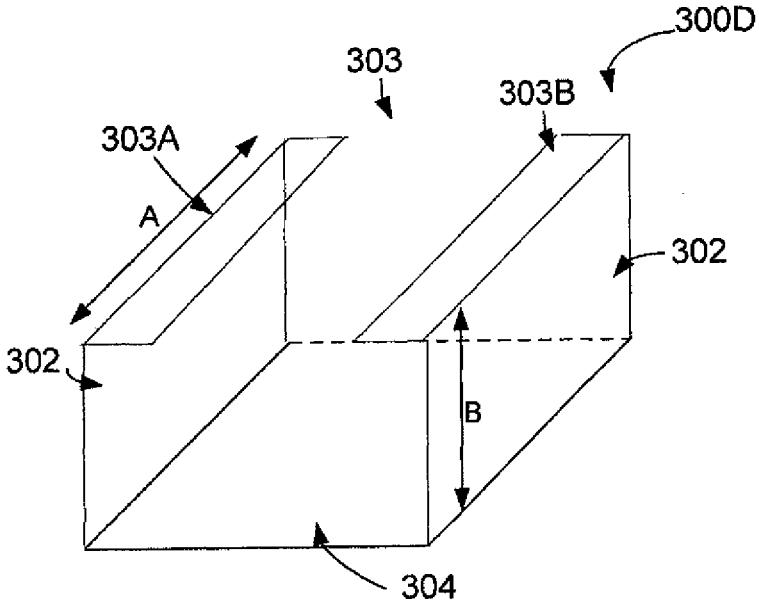
FIG. 6 is schematic diagram of another example spacer.
Figure 7:
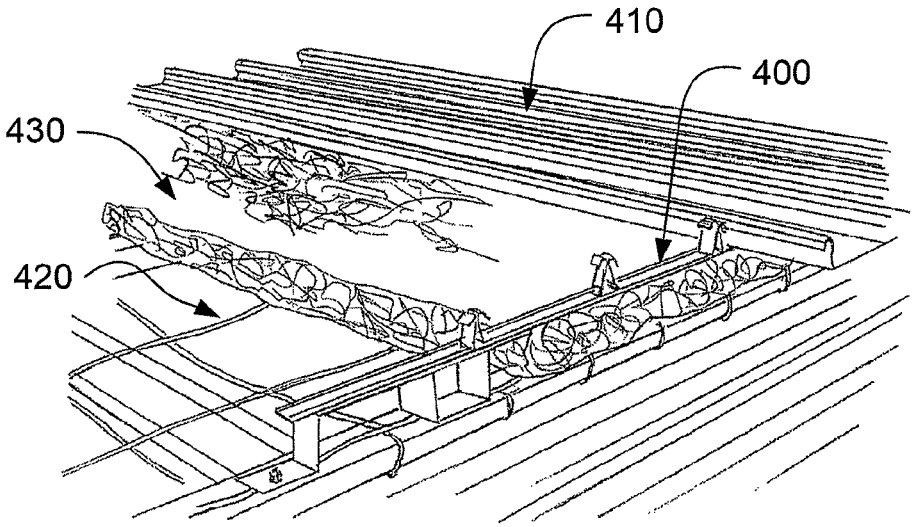
FIG. 7 is a photograph of an example of a spacer in use.

Various other forms of spacers 30013 to 300D are shown in FIGS. 4 to 6.

FIG. 4 shows a spacer 300C which is shaped as a rectangular prism, and has a supporting body 303 with supporting legs 302 extending from the supporting body 303, but also includes a supporting base 304, where the supporting base 304 can be attached to the second roof member.

The spacer 300D of FIG. 6 is similar to the spacers of FIGS. 3 and 5, however, spacer 300D is a "reversed" version of the spacer 300C of FIG. 5. Thus, the spacer 300D of FIG. 6 has a supporting base 304, which can be attached to the second roof member 320, and includes supporting legs 302 extending from the supporting base 304. The supporting body 303 of the spacer 300D includes separate body elements 303A and 303B, which are extending edges from the supporting legs 302.

Accordingly, it will be appreciated that any shape of spacer can be used to provide space between roof members.

The spacers shown in FIGS. 3 to 6 are generally of the form of roof bracket that, in these examples, can be pre-attached to a roof clip, or the like, at time of roof clip production. This can allow an "all in one" roof fixing bracket to be used on roof installation that can allow the roof insulation to reach its full R rating with a air gap between the insulation and the roof sheet on a clip fixed roof.

Notably, the spacer can be attached to roof clips by any means, for example, by screws, rivets, welding, button punching, or the like. The roof fixing bracket can then be attached to roof purlins by fixing with 10/16 or 12/20 tek screws. It will be appreciated that any other means of fixing the roof fixing bracket to the roof purlins apparent to persons skilled in the ID art, is considered to fall within the spirit and scope of the present application.

In one particular example, the roof fixing bracket can eliminate packing to the top of the roof purlins after the installation of the insulation and then installing a bracket over the packing. Thus, in one example, by providing the spacer together with the roof clip, roof insulators can be placed on the roof safety mesh, without having the need to lift the insulating material to place spacers in at a later time.

Accordingly, a gap can be created between the roof and roof safe mesh by installation of the roof fixing bracket to allow the fibreglass insulation to expand and reach its full potential, thereby limiting compression of the insulator. Thus, the roof fixing bracket can eliminate/limit packing requirements and allow an all in one fitting of the roof clip, together with the spacer.

It will be appreciated by persons skilled in the art that the roof fixing bracket can come in varying heights to suit the insulation and R rating required for each application. Examples of heights include 30 mm, 60 mm, 90 mm, and 120 mm high brackets, although it will be appreciated that the sizes available can be determined in accordance with available roof insulators/insulating products, and in one example, the space provided by the spacer ranges from 10 mm to 120 mm, inclusive.

In one example, each roof fixing bracket provides sufficient area against both the roof sheet and roof purlin with mid supports where necessary to allow the roof sheet to obtain full strength to support foot traffic as required.

It will be appreciated by persons skilled in the art that the gauge, length, and width of the roof fixing bracket can be determined, and varied, depending on the use of the bracket and the type of insulator being used. In one example, the gauge of the roof fixing bracket may be varied to allow for the varied height required for the brackets for different R rating requirements. This is further highlighted in the example spacers of FIGS. 3 to 6, where the length ("A"), height ("B") and width ("C") of the spacers are varied in order to suit various roof insulators.

Thus, for example, as the height of the bracket is increased from 30 mm to 100 mm, the gauge of the bracket can also be increased to obtain a required wall strength, as the increase in bracket height increases the tension on the walls (or legs of the bracket). Accordingly, the gauge of the bracket can be increased in a variety of ways, including but not limited to increasing the gauge of the bracket material (that is the material composition of the bracket, for example by making the bracket from a heavier gauge), and/or crimping or bending the bracket legs in order to add overall strength.

In one further example, it will be appreciated that the above-described spacer can be made of any suitable material including but not limited to, any material suitable for roof construction purposes such as wood, metal, steel, or the like.

It will also be appreciated that the above-described spacer can be used for providing space for any type of insulator, and in one example, can include roof insulators made from fibreglass or the like.

Additionally, the above-described spacer can provide numerous advantages. In one example, the spacer (either used separately or as roof fixing bracket with roof clips) can allow roof fixers to install roof sheeting in an identical or similar manner to the way in which roofers laid out roof and insulating products prior to the introduction of regulations requiring the maintenance of an insulators R rating, without compromising integrity or safety.

Furthermore, the spacer can provide a cost efficient manner of providing the spacer between roof members as the spacer can be purchased by a user either separately or as a part of the roof clip (as a roof bracket).

Figure 8:
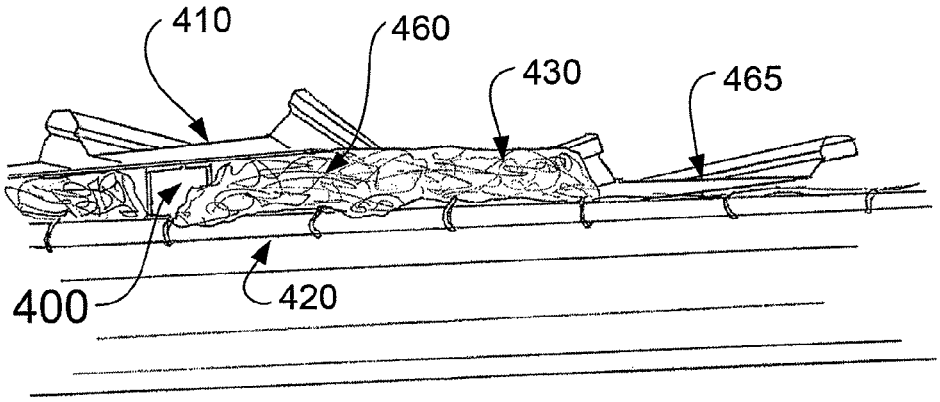
FIG. 8 is a photograph of another example of a spacer in use.

FIGS. 7, 8, 10, and 11 show example photographs of a spacer 400 in use, for providing space for an insulator 430 between roof members 410 and 420. FIG. 8 shows, at 465 roof sheet installation with no or limited air gap between the roof members 410 and 420, and at 460 an air gap that is achieved from the installation of the spacer 400. In this particular example, the insulator 430 displayed has a height of 75 mm and is able to achieve its full potential thickness with the use of the spacer 400 (as shown at 460), and only 15 mm without the use of the spacer (at 465).

Figure 9:
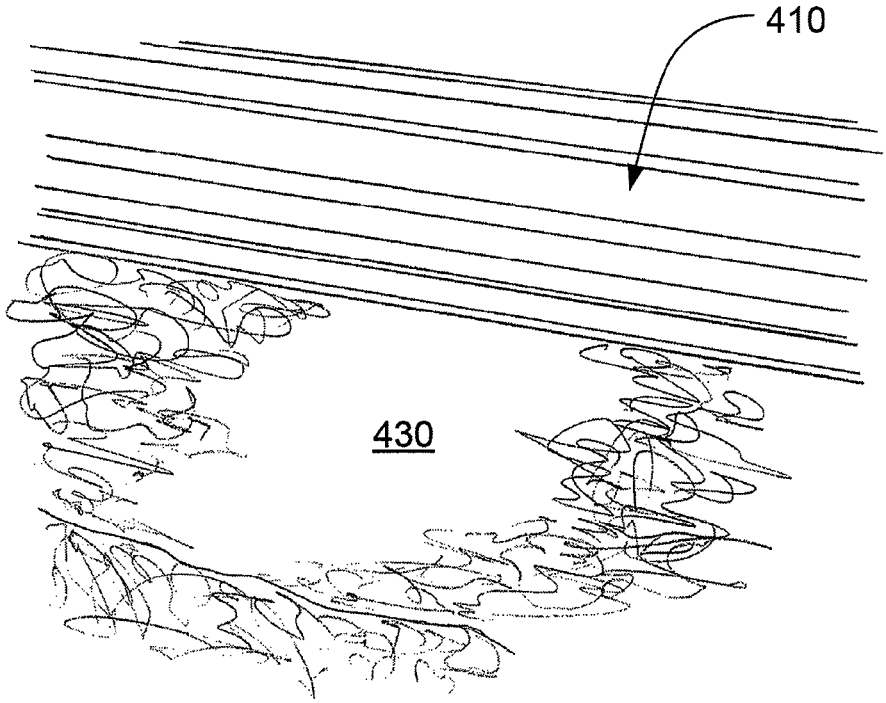
FIG. 9 is a photograph of an example of an insulator without the use of a spacer.
Figure 10:
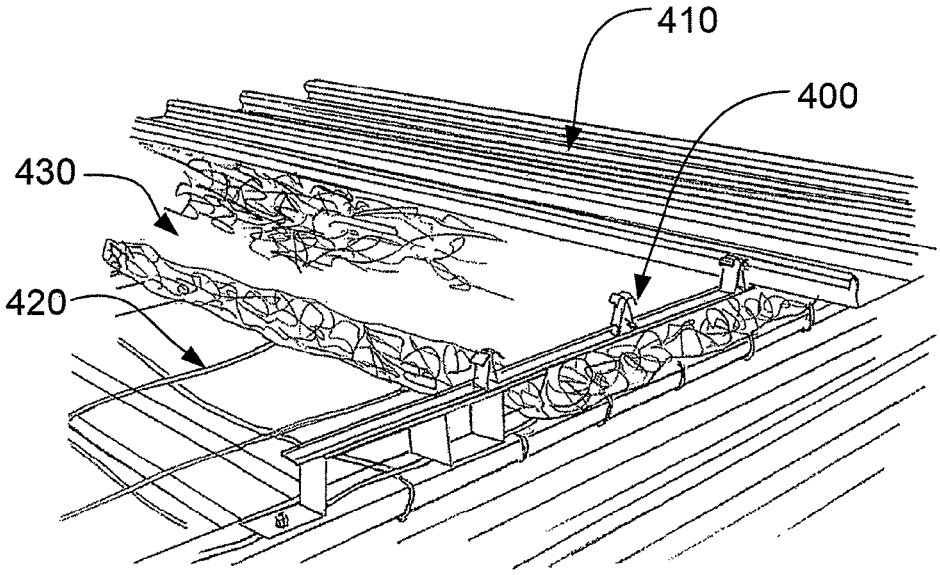
FIG. 10 is a photograph of an example of an insulator with the use of a spacer.
Figure 11:
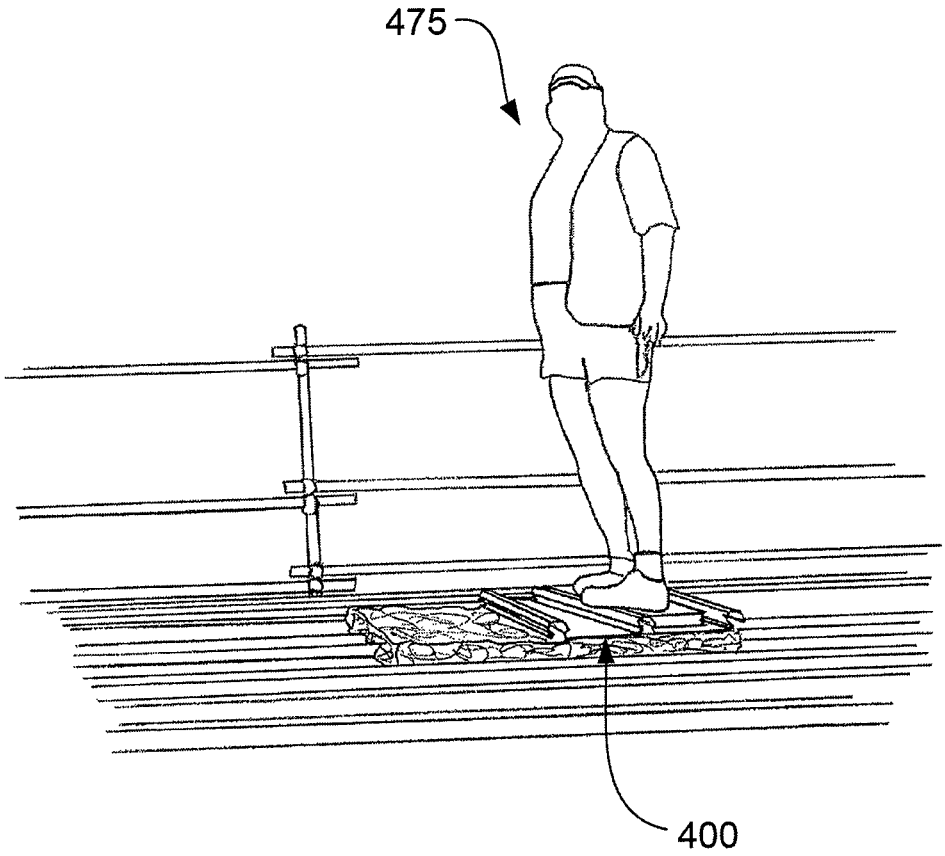
FIG. 11 is a photograph of an example of a spacer in use, the spacer being configured so that the spacer is able to withstand the weight of a roofer.

FIG. 9 shows an example photograph of an insulator 430, without the use of a spacer, which compromises the R rating of the insulator 430. FIG. 11 shows an example of the strength of the spacer 400, which is able to withstand the weight of a roofer 475. Notably, in these examples, the spacer 400 is or forms part of a roof clip.

FURTHER EXAMPLES

FIGS. 12A to 12D show examples of a spacer, in the form of a crenellated insulation support bracket 501.

Figure 12A:
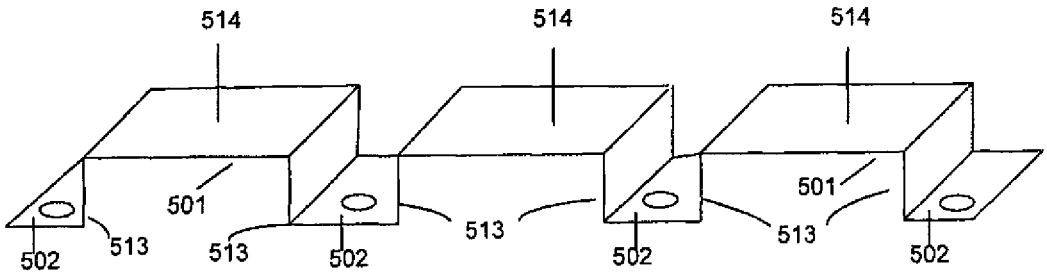
FIG. 12A is a schematic diagram of another example of a spacer.

In particular, FIG. 12A shows a light weight galvanised flat strap pressed into a crenellated profile as a crenellated support bracket 501, having pre-punched holes 502 for attachment screws 509 to secure the bracket 501 to the roof support member 508 (where a screw driver can be used to reach the bracket 501).

Figure 12B:
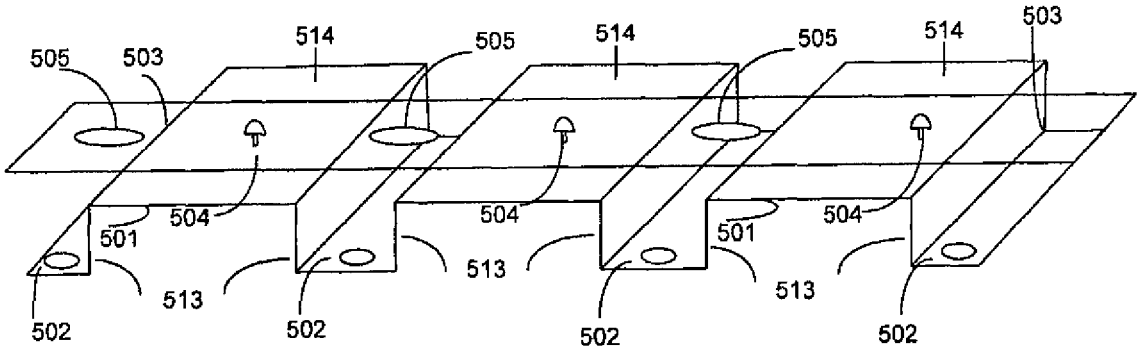
FIG. 12B is another schematic diagram of another example of a spacer.

FIG. 12B shows a flat strip 503 fixed over the bracket 501 to allow for screw fixed roof sheeting, where attachment approved fixing screws, rivets or the like 504, fix the flat strip 503 or roof clip 506 to the crenellated insulation support bracket 501.

Figure 12C:
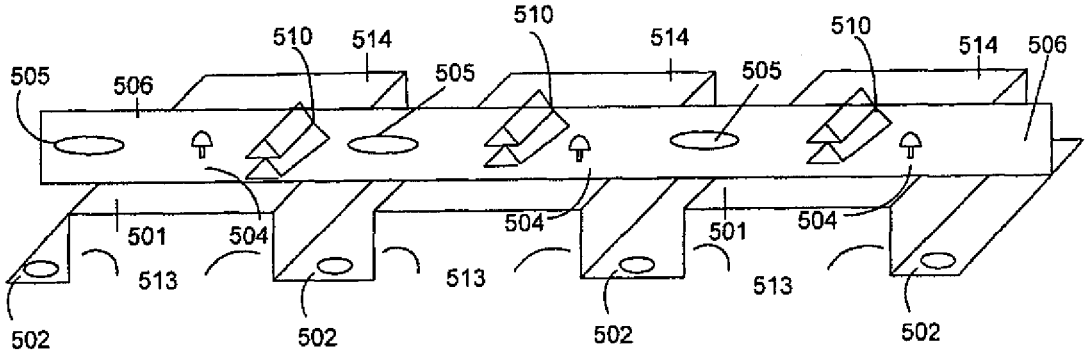
FIG. 12C is another schematic diagram of another example of a spacer.

FIG. 12C shows the concealed clips 506 for installing a concealed clip fixed metal roof 507. It will be appreciated by persons skilled in the art that a concealed roof clip is one that can be used for Kliplok® or similar type of roof sheet. The roof clip is typically located between the roof purlin and the roof sheet, where the roof clip is fixed to the roof purlin, the roof sheet being pushed over the roof clip, so that the roof clip is able to clip the roof sheet. Typically, the roof clip cannot be seen after the roof sheets are installed.

Figure 12D:
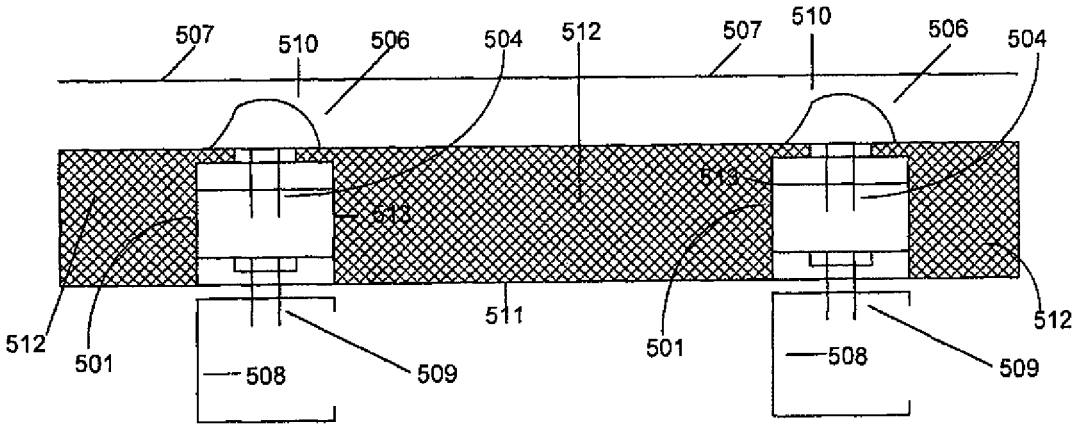
FIG. 12D is another schematic diagram of another example of a spacer.

FIG. 12D shows a metal roof sheet 507, which is usually concealed clip fixed (and can be screw fixed). FIG. 12D also shows a roof support member 508, which can usually be a C or Z shaped roof purlin, or alternatively can also be a timber member (or timber portion of the roof). The attachment screw 509 for attaching the crenellated insulation support bracket 501 to the roof support member 508, is also shown in FIG. 12D, together with the roof clip attachment point 510 for the roof sheet, roof safe mesh wire support 511, insulation blanket 512, and the crenellated insulation support bracket support leg 513.

As discussed above, the roof insulation 512 generally requires a gap between the roof safe mesh 511 and a metal roof sheet 507 in order to obtain an R rating for the insulation 512. The required R rating can be obtained by maintaining full thickness of the insulation 512, and preventing crushing or deformation of the insulation 512, except when over the actual roof support member 508.

Thus, in this example, the crenellated insulation support bracket 501 has the particular shape as shown in FIGS. 12A to 12D. In particular, the bracket 501 can be a single piece with numerous legs 513 and crests 514 (where in the example shown in the figures, bracket 501 has three or more legs 513 and two or more crests 514 to support the roof clip 506). Additionally, the bracket 501 can be designed so that the bracket 501 is equal in length to the width of the roof sheet 507.

In this example, the roof clip 506 has a mid support in the form of the crenellated section of the crenellated insulation support bracket 501.

It will be appreciated by persons skilled in the art that the height can be manufactured to a height as desired to reach the different gap requirements for the roof insulation 512.

The crenellated insulation support bracket 501 of FIGS. 12A to 12D can provide numerous advantages, some of which are described below.

In one example, the crenellated shape Insulation Support bracket 501 can allow for fixing with shorter screws 509 instead of 120 mm×12 mm fixings, which are normally used with solid insulation packer (which can be a solid timber packer or a solid foam piece acting as a packer). The shorter screws 509, which are usually of 16 mm generally do not roll over the roof purlin as would a screws of 100 mm that would be required if they had to pass through a packing material. Additionally, the shorter screws 509 are usually easier to work with than 100 mm screws.

Thus, the crenellated insulation support bracket 501 can prevent the effect of rolling across the purlin 508 as is with C, Z or U shaped support brackets (which are discussed further to below) of equal gauge. It will be appreciated by persons skilled in the art that rolling often occurs when the roof is fixed and expands (due to temperature variation or the like), which can cause the roof to move over the purlin/insulation.

In a further example, the crenellated shape insulation support bracket 501 allows for fixing with 10×16 mm 509 hex head screws rather than countersunk 120 mm screws, which are generally used with solid insulation packers.

Additionally, it will be appreciated that the simple design of the crenellated insulation support bracket 501 can provide sufficient strength for roof installation at low costs as the bracket can be manufactured from lightweight material.

The design of the crenellated insulation support bracket 501 can also allow for fixing of roof clips 506 without having their width changed to suit channel shaped supports, which would generally be wider than a standard roof clip.

Furthermore, the crenellated insulation support bracket 501 can be stamped to shape in a one piece full length strip ready to be fixed to the existing roof clip 506. It will be appreciated that the crenellated insulation support bracket 501 can be attached to a flat support 508 to allow for installation of screw fixed roof sheets if required. Further still, the crenellated insulation support bracket 501 can be produced in two or more pieces if desirable.

Accordingly, in this example the crenellated insulation support bracket 501 can allow the insulation 512 to achieve its full recovered thickness potential. Additionally, the bracket 501 can reduce after construction costs for the heating and cooling of a building. When insulation 512 is crushed/compressed the insulation loses its thermal resistance and its effectiveness is reduced. The crenellated insulation support bracket 501 can allow the use of 100 mm building blanket 512 in order to satisfy requirements for energy efficiency in commercial building as required, for example, in the Building Code of Australia.

Another advantage that the crenellated insulation support bracket 501 can provide is that the bracket 501 is generally simpler to fix than a solid packing piece that would require fixing screws up to 120 mm in length and would still tend to roll across the purlin. However, the bracket 501 can be fixed with a 16 mm 509 roof screw and once fixed, the bracket becomes a solid support.

Furthermore, the crenellated insulation support bracket 501 can be fixed to existing roof clips 506 off site. Thus, when delivered to site, the bracket 501 would generally not require any additional work or installation costs for the roof fixer. Alternatively, it will be appreciated that the clip and bracket may be attached on site to reduce packing and transit costs.

The crenellated insulation support bracket 501 fits longitudinally over the support member 508 and can be fixed by standard screws 509 which can be long enough to pass through the gauge of the roof bracket 501, compressed insulation 512 and the roof purlin 508. The approximate length of the screw 209 can be 16 mm rather than using a full height packer generally requires a screw to extend 100 mm through the insulation 512 gap prior to penetrating the roof purlin 508. It will be appreciated by persons skilled in the art that the longer length between the screw head and the fixing point the larger rolling affect over the purlin.

The crenellated insulation support bracket 501 can be installed over the top of the roof safe mesh 511 and insulation 512 which is installed over the roof purlins 508. The crenellated insulation support bracket 501 can have a roof clip 506 pre-attached (or can form a part of the roof clip 506) and can create a gap between the roof sheet 507 and the roof safe mesh 511 to suit the insulation 512.

Furthermore, the use of the crenellated insulation support bracket 501 generally does not require the width of a roof clip 506 to be changed (which is usually required if using a U shaped bracket or the like). In this example, each crenellated insulation support bracket 501 is the full width of the proposed roof sheet 507, which enables the roof fixer to clamp the bracket 501 in position by clipping to the previous roof sheet 507 and then screwing (by fixings or screws 509) into position the bracket 501, whilst using foot pressure to hold the bracket 501 down.

The particular shape of the bracket 501 can provide advantages over other shapes of brackets.

FIGS. 13A, 13B, 13C, and 13D show examples of a U bracket (520A) with legs 526 facing towards the roof purlin 508, a U bracket (520B) with legs 525 facing away from the roof purlin 508, a C support bracket (521) and a Z support bracket (522), respectively.

Figure 13A:
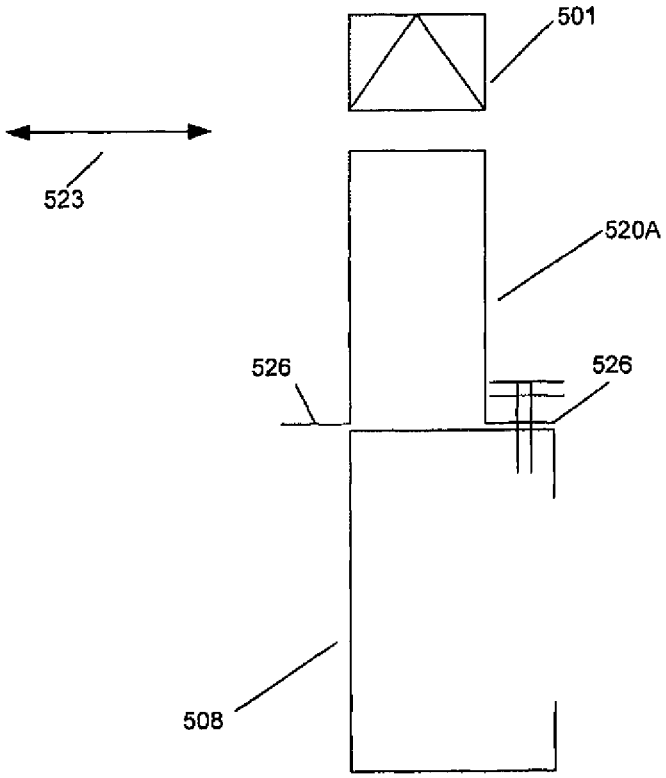
FIG. 13A is a schematic diagram of an example U-shaped spacer.
Figure 13B:
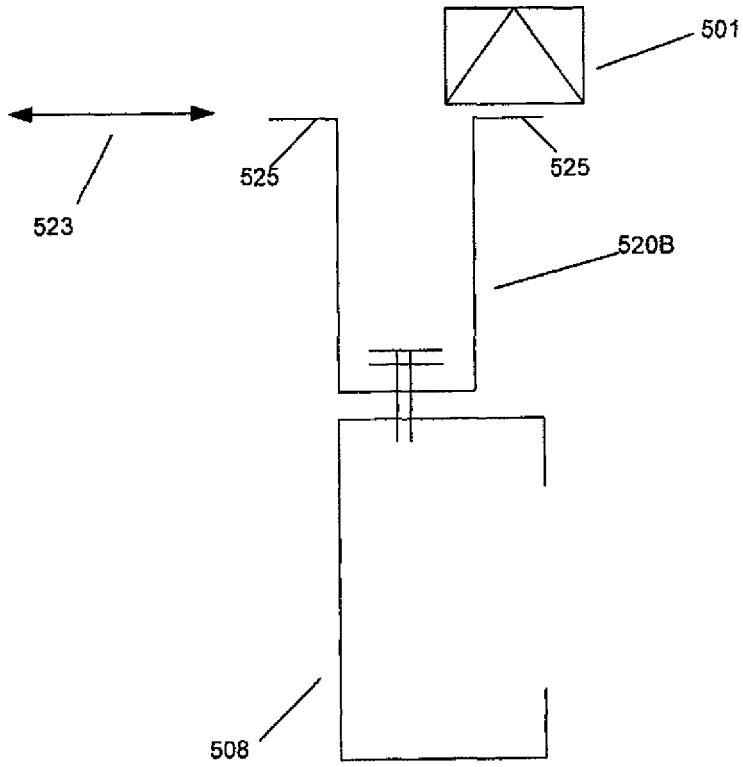
FIG. 13B is a schematic diagram of an example U-shaped spacer with the legs facing away from the roof purlin.
Figure 13C:
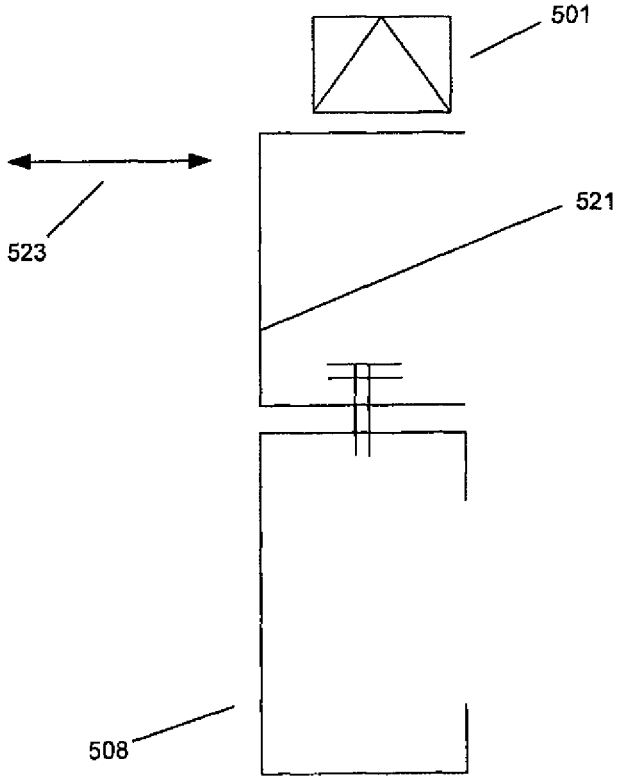
FIG. 13C is a schematic diagram of an example C-shaped spacer.
Figure 13D:
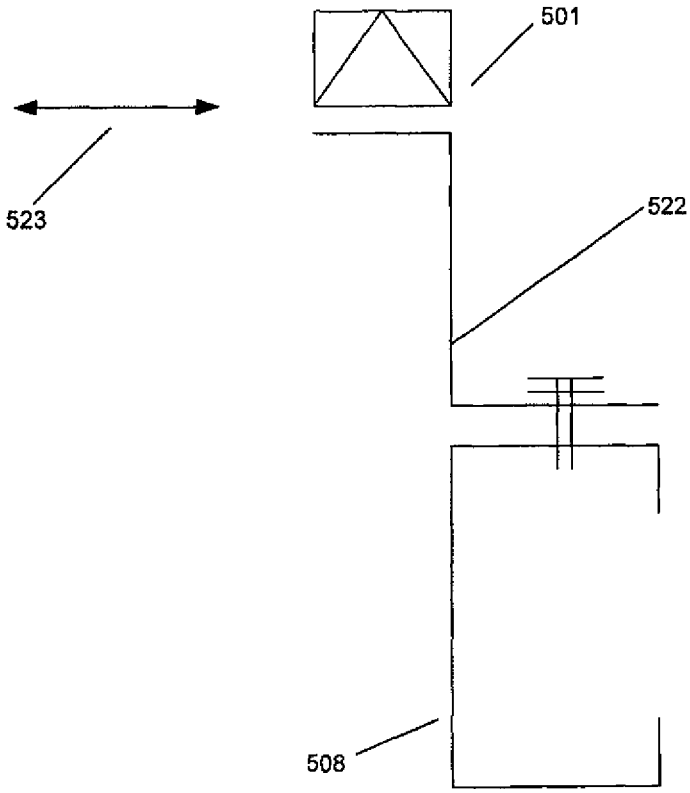
FIG. 13D is a schematic diagram of an example Z-shaped spacer.

In one example, a "U" shaped support bracket (as shown in FIG. 13B) generally requires a top lip (such as the legs 525) extending outwards to accept the roof clip. Thus, if a "U" shaped bracket is used the standard roof clips 506, may generally be too narrow to be fixed to both legs 525. Furthermore, if the "U" shaped bracket is inverted (as shown in FIG. 13A) the top lips become support feet 526 and they can be too wide to allow for support fixings into the roof purlins 508 on both legs 526. Generally, as it would be desirable to locate both legs 526 on the support purlin 508, it is generally required that one outside edge of the foot support would align directly with the outside edge of the roof support purlins 508. It will be appreciated that this edge can be very difficult to locate once the roof safe mesh 511 and insulation 512 have been installed.

Thus, the crenellated bracket 501, can in one example, eliminate this problem as the fixing point of the bracket 501 can be at or near the centre of the purlin 508. Furthermore, the bracket 501, in one example, does not suffer from the problem of the existing roof clips 506 not being wide enough to use with a "U" bracket as the bracket 501 can provide a full width attachment area.

Additionally, it can be simpler to locate fixing grounds for the crenellated insulation support bracket 501 as an area near the centre of the purlin 508 can be located for fixing and not necessarily near the edge of the purlin 508.

It will also be appreciated that if used up-wards (that is, the legs of the U-bracket facing away from the roof purlin 508), the U bracket is generally too wide to fix a roof clip 506 to both legs of the U bracket, unless the existing roof clips 506 are widened. If the clip 506 is not attached to both sides the bracket becomes a C bracket and is typically subject to rolling.

Accordingly, the crenellated insulation support bracket 501 can provide an advantage over a C, Z or U shaped bracket of the same gauge and height as C, Z, or U shaped brackets are usually subject to the rolling effect if they are of a sufficient height to be suitable for 100 mm insulation 512. Notably, the direction of rolling that can occur is indicated by the arrow 523. Thus, the bracket 501 can be structurally sound.

In a further example, the crenellated insulation support bracket 501 has legs 513 that cross the roof purlin 508 at 90 degrees, thereby preventing/limiting the rolling effect. It will be appreciated that although in this example, the legs 513 rise at 90 degrees to the purlin 508, so that the legs 513 provide strong support for the roof sheet, variations from 90 degrees fall within the scope and spirit of the present application.

In this example, a standard screw 509 of approximately 16 mm is used for insulation 512, which can be 100 mm thick. The screw 509 can provide numerous advantages over a long roof screw, which is often used on a solid insulation packer or C-shaped support bracket. These advantages can include:

a) Preventing the support member rolling on the roof purlin 508. It will be appreciated that the effect of rolling on the roof purlin 508 can create a tendency for the fixing 509 (which can be a screw, support bolt, or the like) to crack. Furthermore, rolling can also cause the roof support member to deteriorate. Additionally, it will be appreciated that the rolling effect caused by the extra long screws can place extra stress on the top plate of the lightweight purlins 508 that may result in structural defects.

b) Reducing the cost for supplying the standard screw fixings 509, in comparison to the cost of supplying longer screws.

c) Reducing the cost of installation.

d) Limiting the need of up-grading the gauge of the screw 509 as the screw length increases (as it will be appreciated that if a longer screw is used, the gauge of the bracket may also need to be increased).

It will further be appreciated that the length of the crenellated insulation support bracket can allow for the crenellated insulation support bracket 501 to be secured to the roof purlin 508, whilst a tradesman or the like, is supported on a solid working platform such as a previously installed roof sheet 507.

Additionally, the long lengths of C, Z or U support brackets generally require a roof fixer/tradesman to walk onto an unprotected surface to fix the far end of the support, which is generally against work cover regulations.

Accordingly, there has been provided, in accordance with this particular example, a single piece light weight crenellated insulation support bracket 501 equal in length to the width of a nominated roof sheet 507. The bracket 501, can be produced by being stamped into a castellated section 501, which can allow a stronger and easier fixing than C Z or U shaped supports and can allow for smaller fixings (such as screws 509) than a solid insulation piece. Thus, the bracket 501 is, in one example, simple to fix, economical to produce, and generally does not require additional fixing time.

Furthermore, the shape of the crenellated insulation support bracket 501 can yield enough strength when attached to a roof clip 506, such that it can support the roof sheet 509 and does not usually roll at 90° to the roof purlin 508.

Thus, the full width crenellated insulation support bracket 501 can support a roof clip over a roof purlin 508 to allow for installation of full thickness insulation 512 to recover and/or to be maintained at its full thickness.

Accordingly, there has been provided a device/spacer for providing space between roof members, and in particular, there has been provided a spacer which can help to limit compression of an insulator.

In yet a further example, it will be appreciated that the spacer can provide space between any first and second roof members.

Figure 14A:
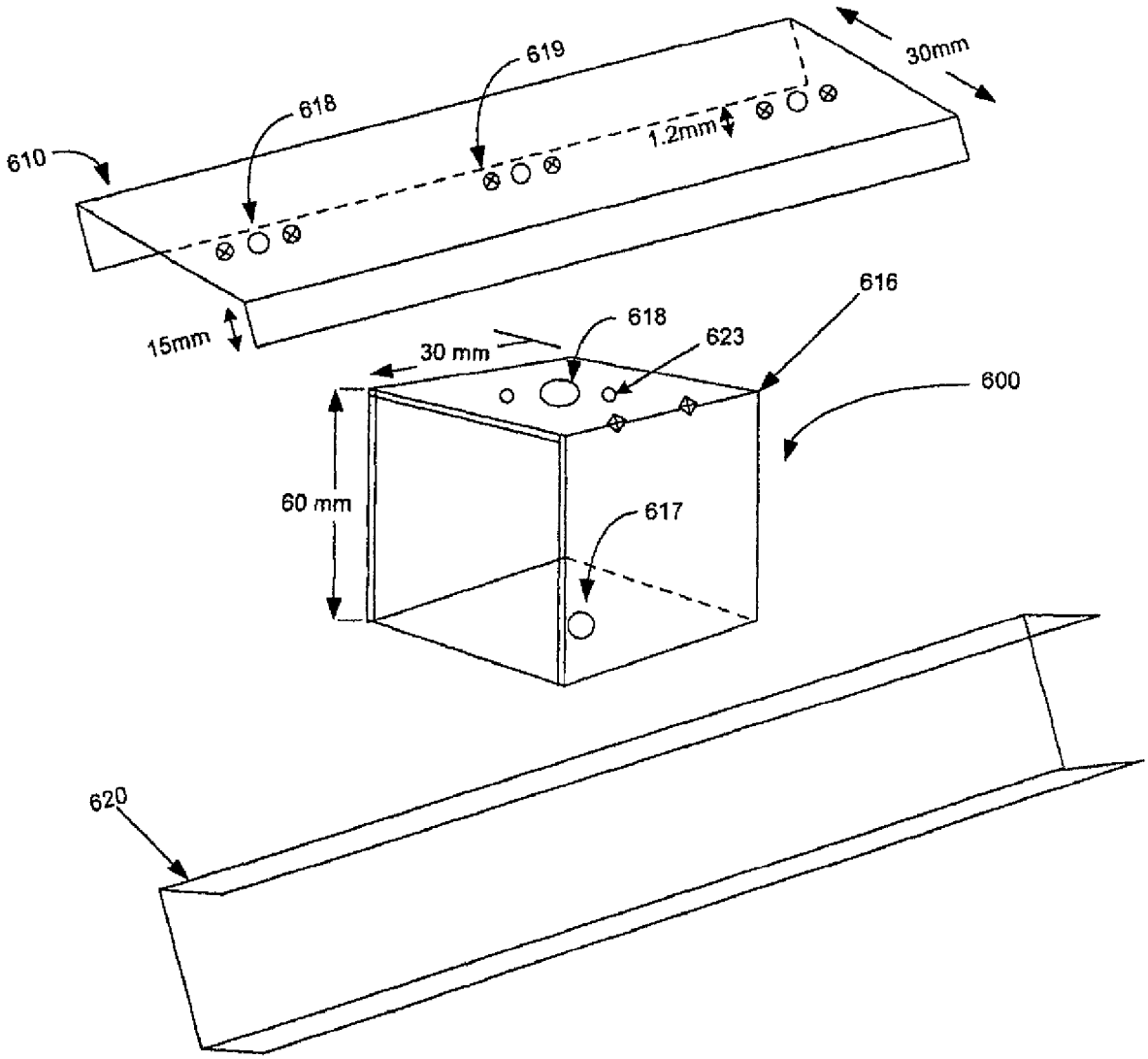
FIG. 14A is a schematic diagram of another example of a spacer being used with a first and a second roof member.
Figure 14B:
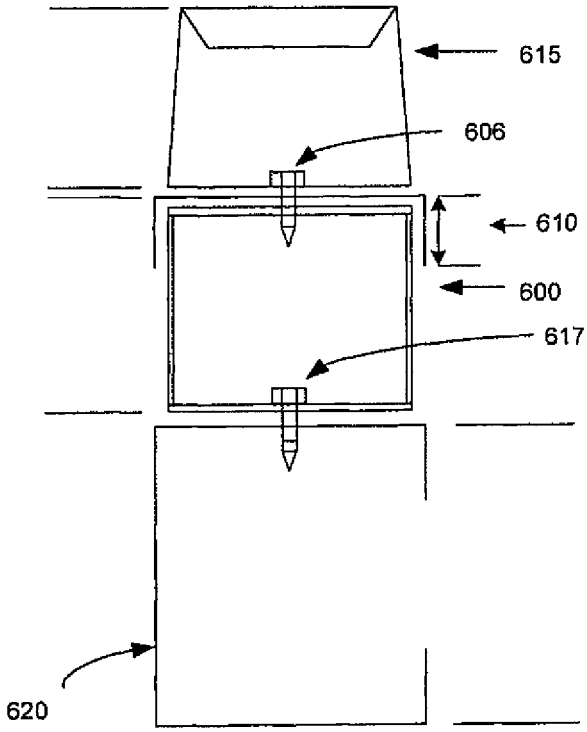
FIG. 14B is a schematic diagram of a side view of the example of FIG. 14A.
Figures 15A, 15B:
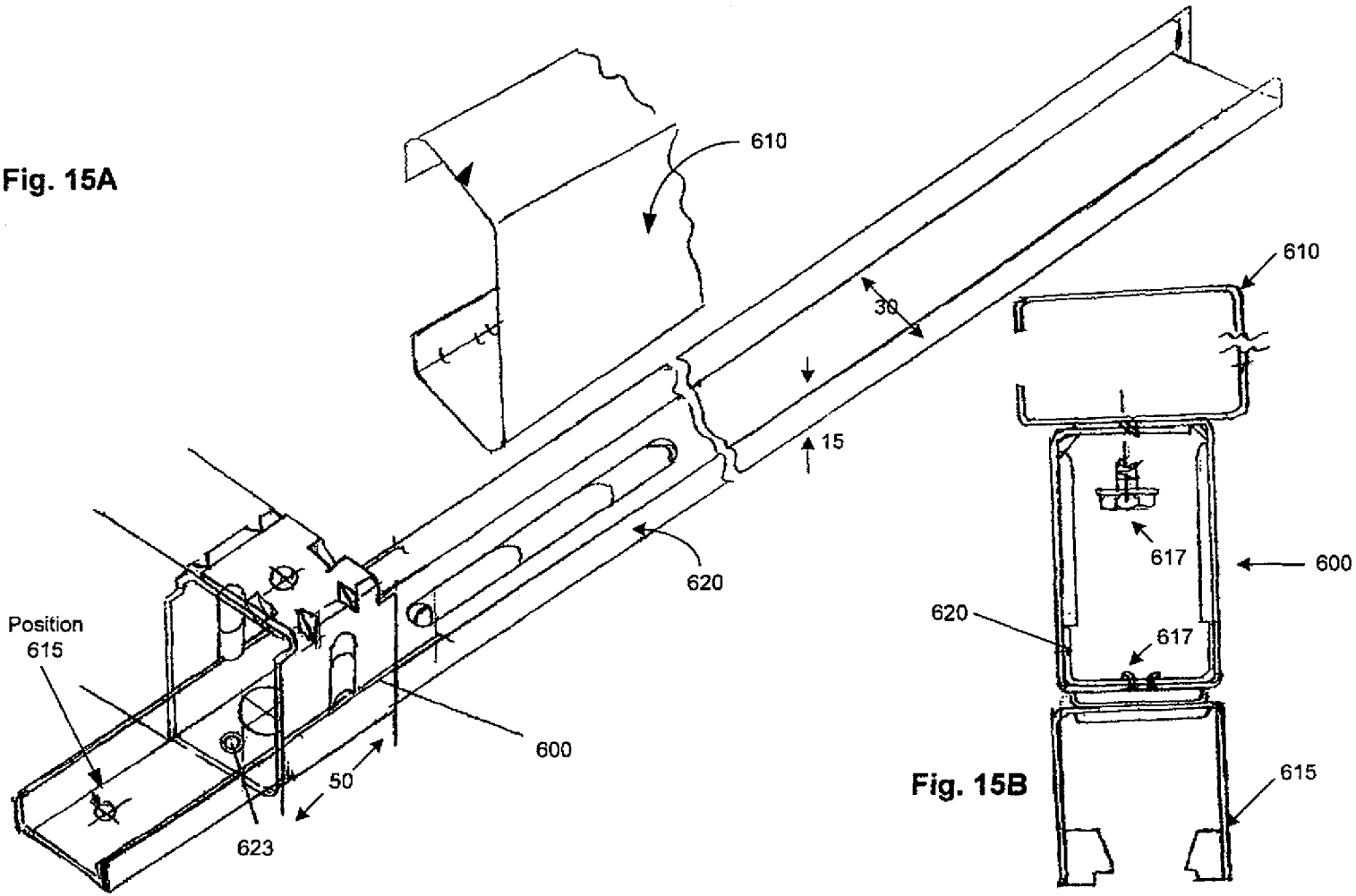
FIG. 15A is another schematic diagram of an example of a spacer being used with a first and a second roof member.
FIG. 15B is a schematic diagram of a side view of the example of FIG. 15A.

Thus, for example, as shown in FIGS. 14A and 14B, the spacer 600 sits between a first roof member 610, and a second roof member 620. In this particular example, the first roof member 610 is roof sheet support channel, which can in turn support either a roof clip 615 or roof sheet, and the second roof member 620 is a roof support member, such as roof purlin.

FIGS. 14A to 15B also show that the first roof member 610 can be attached to the spacer 600 via Tek screws 619 (or any other similar fixing elements to fix the support channel 610 to the spacer 600). Similarly, the spacer 600 can be fixed to the roof purlin 620 via a standard 10/16 Tek screw fixing, or the like, at 617, and the first roof member 610 can be fixed to the roof clip 615 via a similar arrangement at 606. Accordingly, the first roof member can include fixing objects such as a penetration at 618 to allow for the fixing of Tek screws. Additionally, the spacer 600 can include one or more swages 623, which are typically kinks or bends in the material, in order to add strength to the spacer 600.

It will also be appreciated that the spacer can be produced with the support legs made separately and then fixably attached to a support channel. This can allow for the spacer to have sufficient strength in order to achieve industry download and up lift requirements. That is, the download requirement can also be sufficient so that, when the insulation material is being installed, the spacer is able to support the installer's weight after fixing of, in one example, one of the tek screws only. Accordingly, it will be appreciated that having the support legs being made separately can allow for overall additional strength to be built into the bracket.

Notably, FIGS. 14A to 15B show example dimensions for the spacer, first roof member, and the second roof member. It will be appreciated by persons skilled in the art that the dimensions are for illustrative purposes only, and the scope of the present application is not limited to the dimensions shown in the examples.

Additionally, the spacer as described with reference to 12A to 15B is often referred to as a crenellated roof support bracket. The bracket as shown above can include spacers which are of numerous shapes, including but not limited to U, reverse-U, Z, C, or square in shape (that is, the spacer can have these shapes as a cross-section). It will be appreciated that the spacer can also be any variation of these shapes, and in one example, is trapezoidal (as described below), and any other tetrahedral shape.

Further examples of a spacer 700 is shown in FIGS. 16 to 19B.

Figure 16:
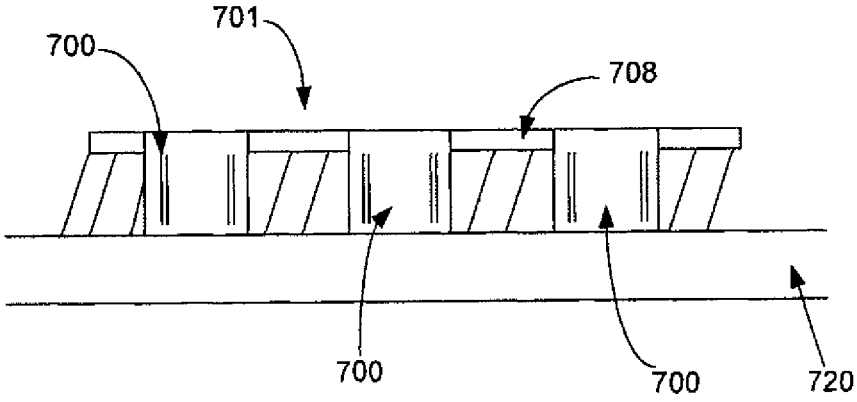
FIG. 16 is a schematic diagram of another example of a spacer.

In particular, FIG. 16 shows the spacer 700 forming a part of a roof bracket 701, and is placed on a second roof member 720 (which can be any roof support member). In this particular example, the roof bracket 701 includes an elongate body 708 which has a plurality of spacers 700 placed along the body, where each spacer 700 is spaced apart from each other spacer 700. Thus, for example, the body 708 of the roof bracket 701 can be 700 mm long, in order to be used/compliment a 700 mm wide roof sheet.

Figure 17:
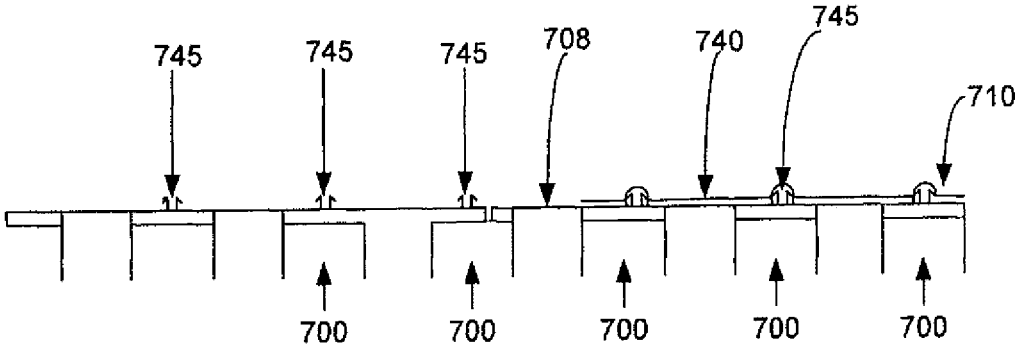
FIG. 17 is a schematic diagram of another example spacer with a first roof member.
Figure 18A:
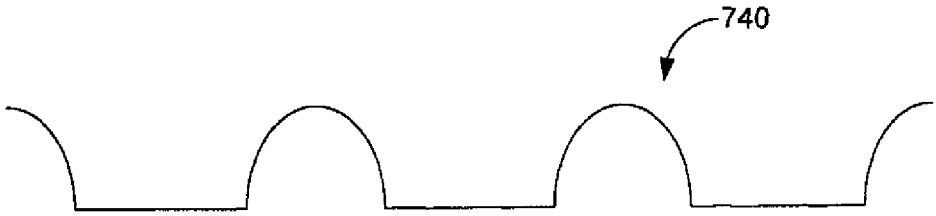
FIG. 18A is a schematic diagram of an example of a roof sheet.
Figure 18B:
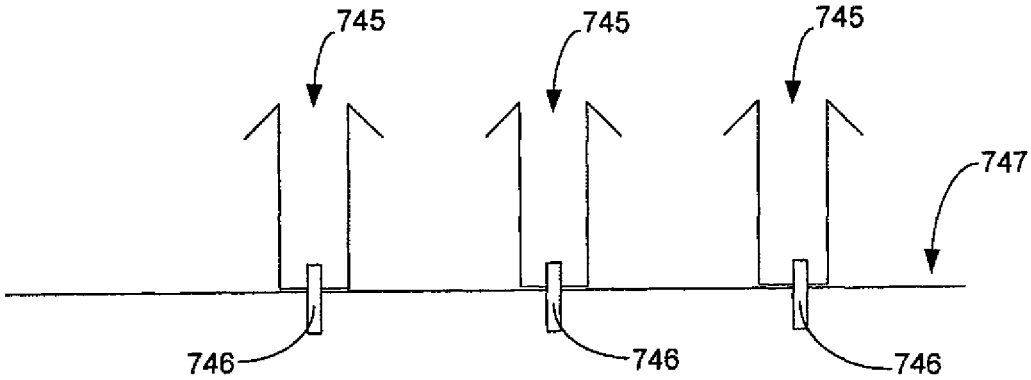
FIG. 18B is a schematic diagram of an example of a roof clip.
Figure 18C:
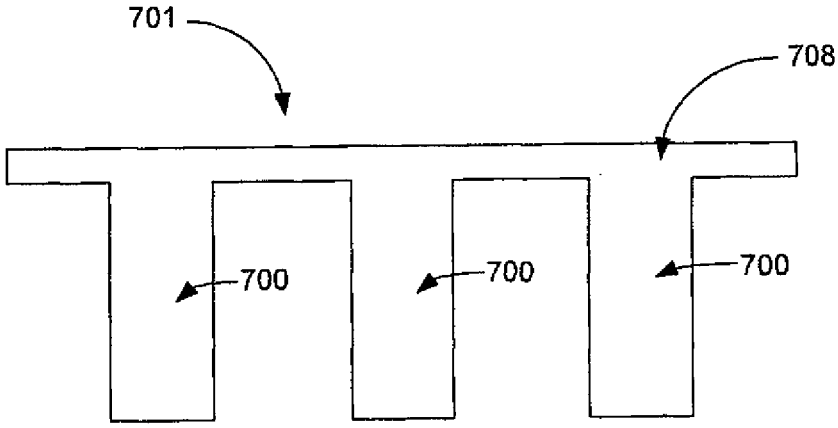
FIG. 18C is a schematic diagram of an example of a roof bracket including spacers.

FIG. 17 shows two separate views of the roof bracket 701 in use, where a first roof member 710 is placed on the elongate body 708. In this example, one portion of the bracket 701 has a first roof member 710, in this case a roof sheet 740 placed over roof clips 745. FIGS. 18A to 18C show separately the roof sheet 740, roof clips 745, and the spacer 700 (as a part of a roof bracket 701 with an elongate body 708), respectively. Notably, the roof clips 745 can be fixed at 746 to a roof clip support 747. The roof clip support 747 can then be fixed to the elongate body 708 of the roof bracket 701.

Figure 19A:
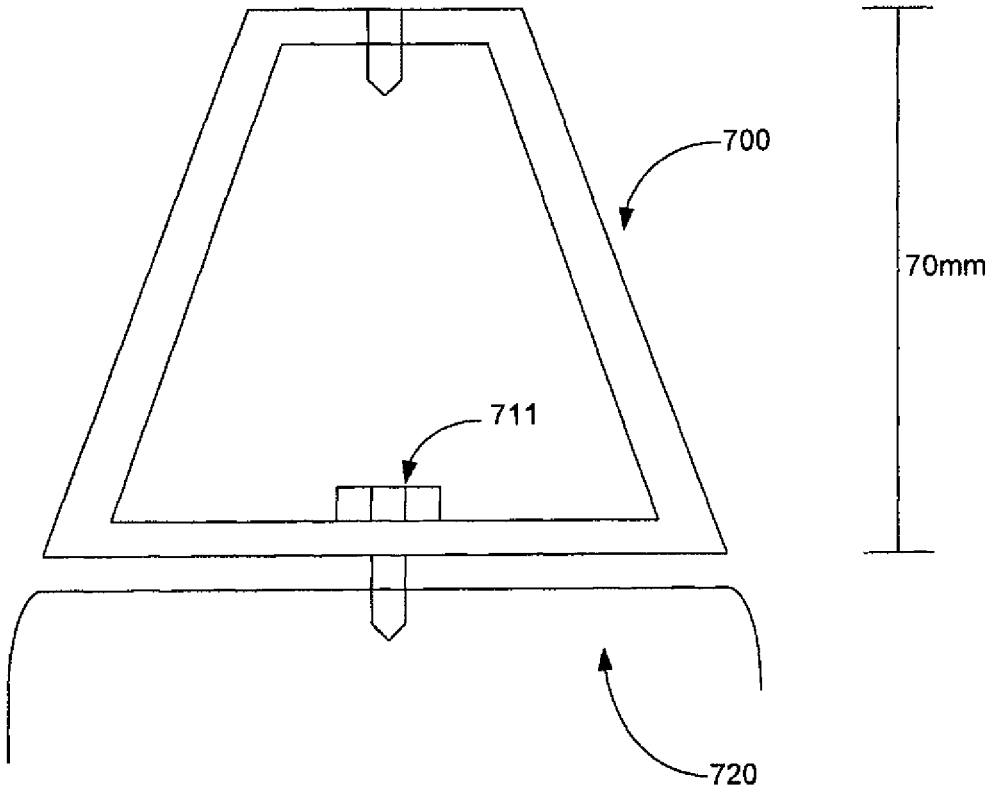
FIG. 19A is a schematic diagram of an example spacer attached to a second roof member.

FIG. 19A shows the spacer 700 being attached to the second roof member 720. In this particular example, the spacer 700 is trapezoidal in shape, and is fixed to the second roof member 720 at by a tek screw 711. Furthermore, in this particular example, the spacer 700 has a height of 70 mm and can thus support an air gap of 70 mm for an insulator. It will be appreciated, however, that spacer's height and the roof bracket's length can be varied to suit the particular insulator and roof members.

Figure 19B:
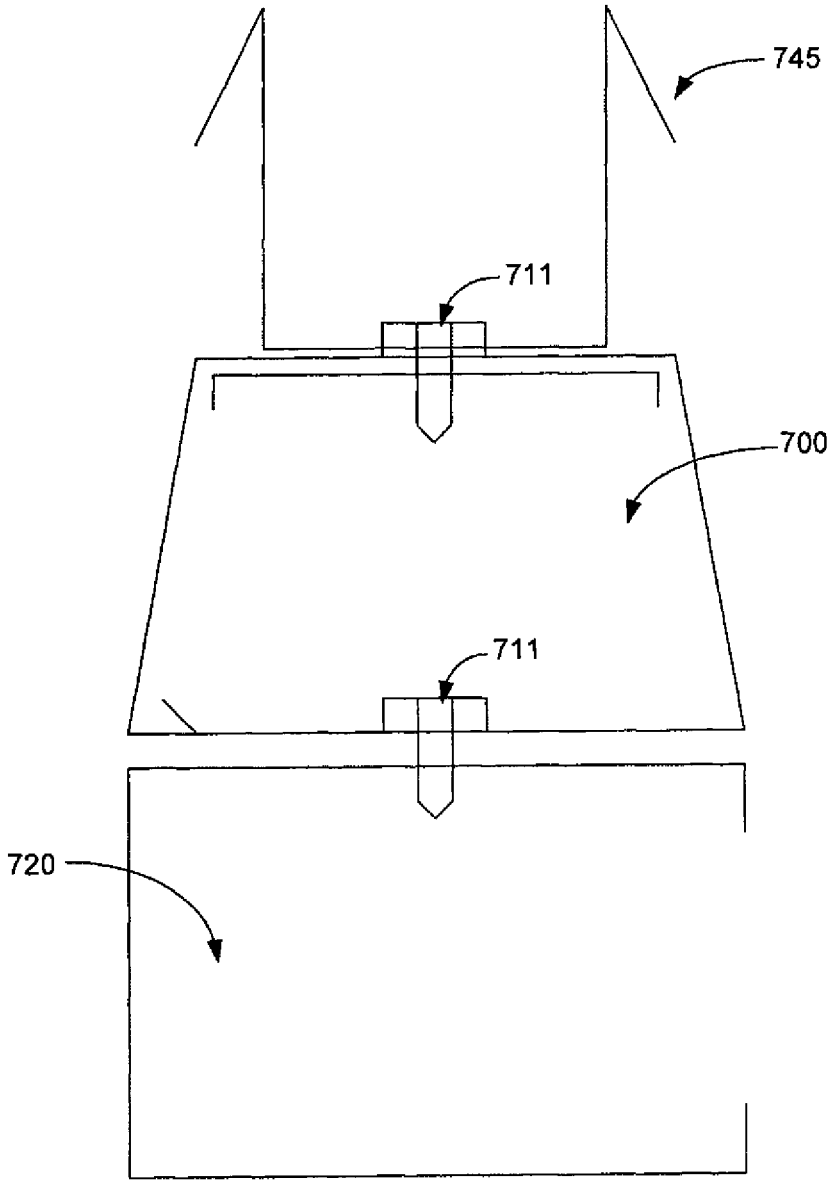
FIG. 19B is a schematic diagram of the example spacer of FIG. 19A attached to a roof clip and the second roof member; and, FIGS. 20 to 27 are photographs of an example spacer in use.
Figure 20:
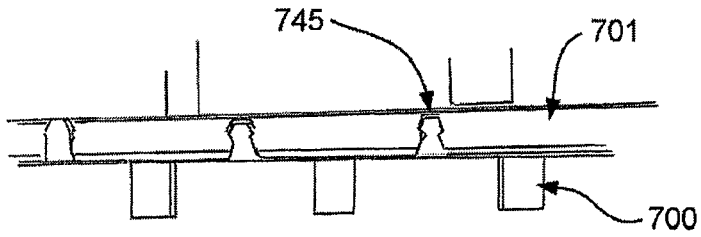

FIG. 19B shows the spacer 700 tek screwed at 711 to a roof clip 745 and to the second roof member 720.

Notably, in one particular example, the tek screws used are small length screws (for example 10×16 mm teks). Furthermore, the spacer 700 (either separately or as a part of the roof bracket 701) can provide numerous advantages, including but not limited to being rigid in order to support foot traffic and not deteriorate over time, being of sufficient strength to withstand weather conditions (such as the possibility of pulling out of the roof support screw or tek screws under storm conditions), and providing sufficient space between the roof sheet and the roof wire to allow the insulation to achieve its designed R rating.

Figure 21:
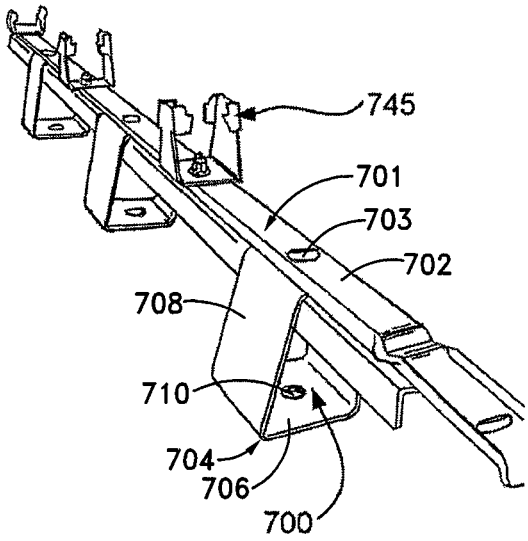
Figure 22:
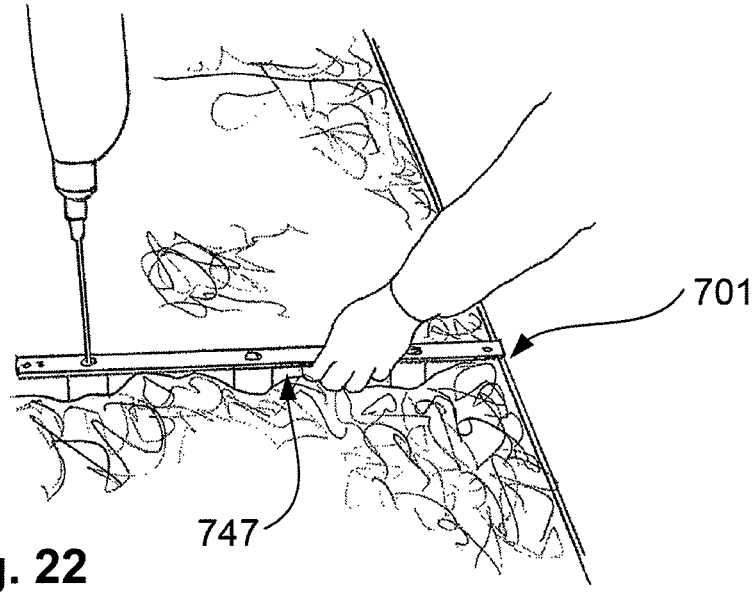
Figure 23:
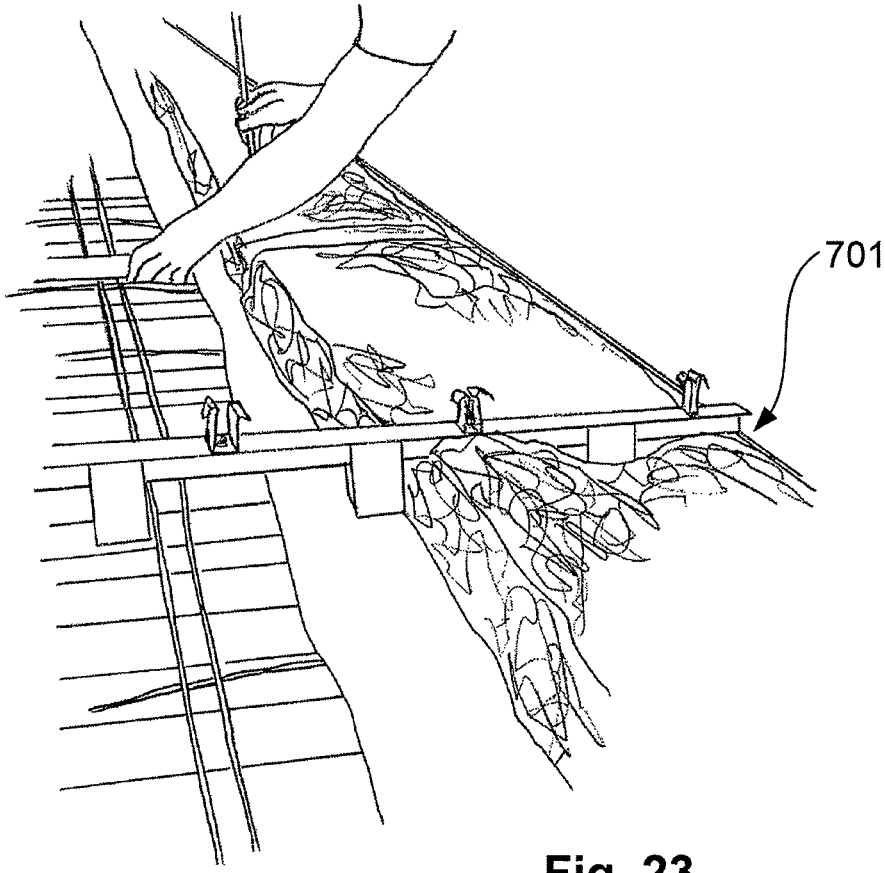
Figure 24:
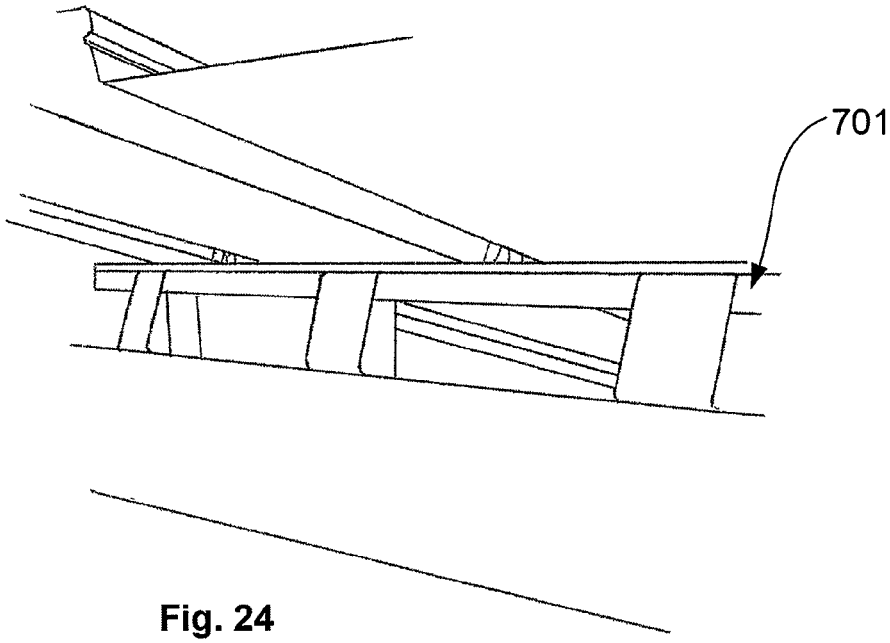
Figure 25:
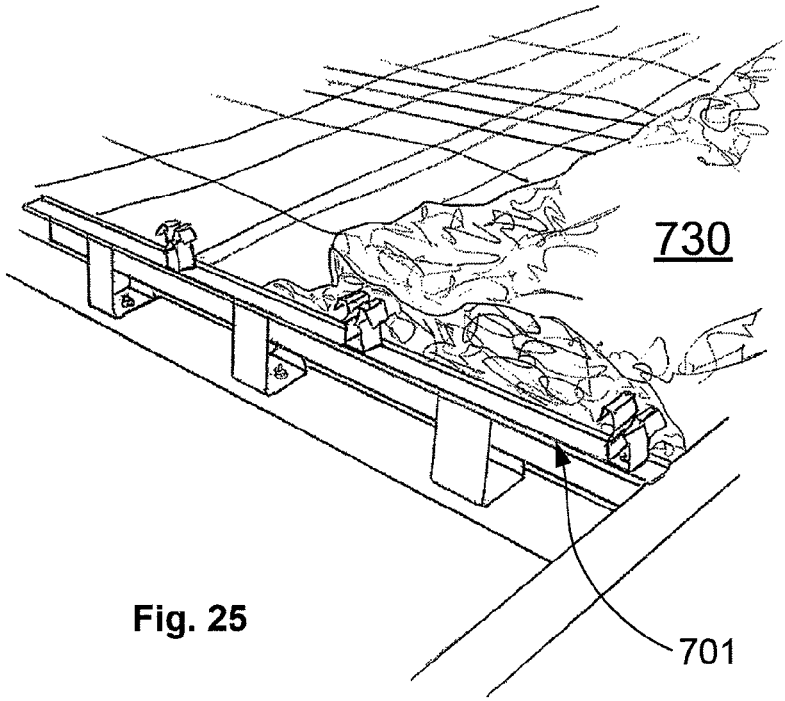
Figure 26:
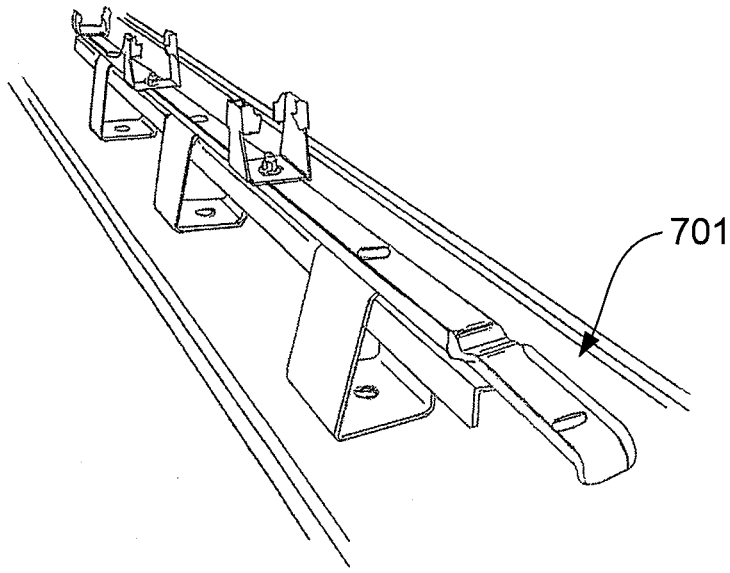
Figure 27:
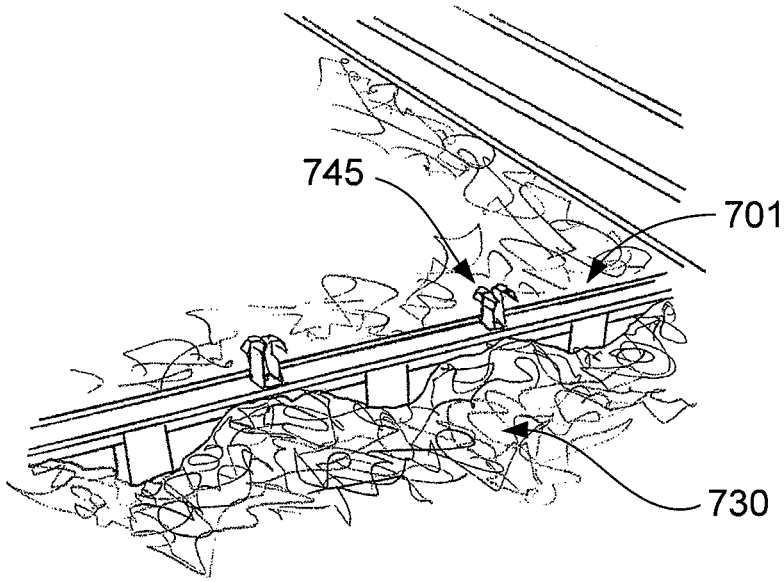

Further examples of the roof bracket 701 with spacers 700 in use to provide a space for insulator 730 is shown in FIGS. 20 to 27. FIG. 21 illustrates a roof bracket 701 having a roof clip 745, a strip 702 and a spacer 700. The strip 702 includes a penetration 703. The spacer 700 includes a a support bracket 704 comprised of a base portion 706 and at least one supporting leg 708 extending upward from the base portion 706. The base portion 706 includes a preformed hole 710. Notably, FIG. 22 shows the fixing of the roof clip support 747 to the bracket 701.

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

The claimed defining the invention are as follows:

1. A spacer for providing a space between a first roof member and a second roof member with an insulator being at least partially between the first roof member and the second roof member, the spacer comprising:

(a) a series of supporting brackets separate from the first and second roof members, each bracket comprising a base portion and at least one supporting leg extending upward from the base portion;

(b) a strip coupled to the upper portions of the supporting brackets;

(c) a first penetration through the strip sized to allow an attaching means to pass entirely through the strip and below the strip;

(d) wherein the penetration through the strip is aligned with the supporting base to allow the attachment means to access the preformed hole in the base portion after passing entirely through the penetration in the strip; and wherein the spacer limits compression of said insulator.

2. The spacer of claim 1, wherein the spacer comprises two or more supporting legs extending from the supporting base, the attaching means being fixed between the two supporting legs.

3. The spacer of claim 2, wherein the spacer is a roof bracket formed from the supporting legs extending from the strip.

4. The spacer of claim 1, wherein the spacer forms a part of a roof clip.

5. The spacer of claim 1, wherein the spacer is attached to a roof clip.

6. The spacer of claim 1, wherein the spacer is of a height that substantially maintains the thickness of the insulator.

7. The spacer of claim 6, wherein the space provided by the spacer ranges from 10mm to 250mm, inclusive.

8. The spacer of claim 1, wherein the first roof member is any one or a combination of:

a roof sheet;

a roof clip supporting member; and, a roof clip support channel.

9. The spacer of claim 1, wherein the second roof member is any one or combination of:

roof purlin;

roof safety mesh; and, roof rafters.

10. The spacer of claim 1, wherein the spacer is a single piece light weight crenellated insulation support bracket.

11. The spacer of claim 1, wherein the spacer has any one or a combination of:

(a) a U-Shaped cross-section;

(b) a reverse U-shaped cross-section;

(c) a Z-shaped cross-section;

(d) C-shaped cross-section;

(e) a square cross-section; and, (f) a trapezoidal cross-section.

12. A roof support bracket configured to provide space between a first roof member and a second roof member with an insulator being at least partially between the first and second roof member, the roof support bracket including:

(a) a metal elongate supporting body;

(b) a metal spacer attached to and extending from the elongate body including a supporting base, and a supporting leg extending from the supporting base; and (c) a penetration through the elongate supporting body configured to allow an attaching means to pass entirely through the elongate supporting body and below the insulator to fix the supporting base to the second roof member, wherein the penetration is laterally aligned with the supporting base, wherein the roof support bracket is provided between the first roof member and the second roof member, and wherein the roof support bracket is configured to provide a space between the first roof member and the second roof member such that there is no compression of said insulator between the first roof member and the second roof member, allowing the insulator to recover to its full nominal thickness between the first and second roof member.

13. The roof support bracket of claim 12, wherein the elongate supporting body of the roof support bracket is attached to a roof clip at one side and the spacer at another side.

14. The roof support bracket of claim 13, wherein the roof clip is configured to attach to a roof sheet.

15. A device for mounting a first roof member to a second roof member, the device including:

a spacer including a leg at one end being adapted to be fixed to the second roof member; and an elongate body fixed to the opposite end of the leg, wherein the elongate body includes a penetration configured to allow a fastener to pass entirely through the elongate body and the leg includes a flange with a slot configured to receive the fastener to attach the flange to the second roof member, the first roof member being attachable to the elongate body with an insulator located between the first and second roof members; wherein the spacer comprises a series of supporting brackets separate from the first and second roof members.

16. The device of claim 15, wherein the spacer includes a pair of legs spaced apart from each other in a direction transverse to the length direction of the elongate body, each of the legs at one end being adapted to be fixed to the second roof member and at the opposite end being connected to the elongate body.

17. The device of claim 16, wherein the legs are splayed and are interconnected by the flange to form a trapezoidal shape.

18. The device of claim 15, wherein a plurality of the spacers are connected to the elongate body at positions spaced apart from each other.

19. The device of claim 15, wherein the leg is formed out of metal.

20. The device of claim 15, wherein the leg is formed with a strengthening crimp or bend.

21. The device of claim 15, wherein the first roof member is a roof clip or a roof sheet.

22. The device of claim 15, wherein the second roof member is a purlin.

23. The device of claim 15, wherein the penetration is configured to allow a fastener to pass substantially entirely through the elongate body.

* * * * *